United States Patent [19]

Edney

[11] 4,070,720

[45] Jan. 31, 1978

[54] DUAL PURPOSE HOME MEDICAL BED

[76] Inventor: Willie C. Edney, Rte. 5, Box 170B, Hendersonville, N.C. 28739

[21] Appl. No.: 585,245

[22] Filed: June 9, 1975

[51] Int. Cl.[2] ..... A45F 1/00; A61G 7/10

[52] U.S. Cl. ..... 5/62; 5/52; 5/92

[58] Field of Search ..... 5/8, 20, 62, 66, 92, 5/317, 52, 53

[56] References Cited

U.S. PATENT DOCUMENTS

| | | | |
|---|---|---|---|
| 3,061,870 | 11/1962 | Giannini, Sr. | 5/8 |
| 3,588,929 | 6/1971 | Bloomberg | 5/62 |
| 3,646,621 | 3/1972 | Fragas | 5/52 |
| 3,686,696 | 8/1972 | Lanigan | 5/66 |
| 3,789,437 | 2/1974 | Garte | 5/62 |

*Primary Examiner*—Casmir A. Nunberg
*Attorney, Agent, or Firm*—Tom R. Vestal

[57] ABSTRACT

A new and useful therapeutic bed frame is disclosed wherein at least one-half of a standard size bed or larger may be elevated for use and returned to level position when not in use.

3 Claims, 9 Drawing Figures

DUAL PURPOSE HOME MEDICAL BED

BACKGROUND OF THE INVENTION

This invention is directed toward an improvement in therapeutic beds useful for persons who must rest and sleep in an inclined position—persons having hiatus hernia and persons with cardiac conditions who must maintain their heads elevated while resting and/or sleeping.

Numerous devices and accessories have been devised to provide bedding with elevatable head and/or foot positions. U.S. Pat. No. 3,259,921 is an example of an accessory for a bed which permits the head of the bed to be raised to an inclined position for use and lowered again.

The prior type of accessory has not been useful for simultaneous occupancy, however. As an example, when either a husband or wife has been required to recline in a head elevated position, the other spouse has had to occupy separate sleeping facilities or accept the reclined position of the partner's bed.

BRIEF DESCRIPTION OF THE PRESENT INVENTION

The present invention is directed to a standard size bed or larger, at least one-half of which is adjustable from level to an inclined position. The invention herein also is directed to means for seiparating each half of the bed for cleaning, bed preparation, and other attendent functions. The herein described invention may be used as a regular bed or one or both sides elevated as needed for therapeutic purposes. Other uses will be apparent from the detailed description of the figures below.

DETAILED DESCRIPTION OF THE DRAWINGS

Figure 1:
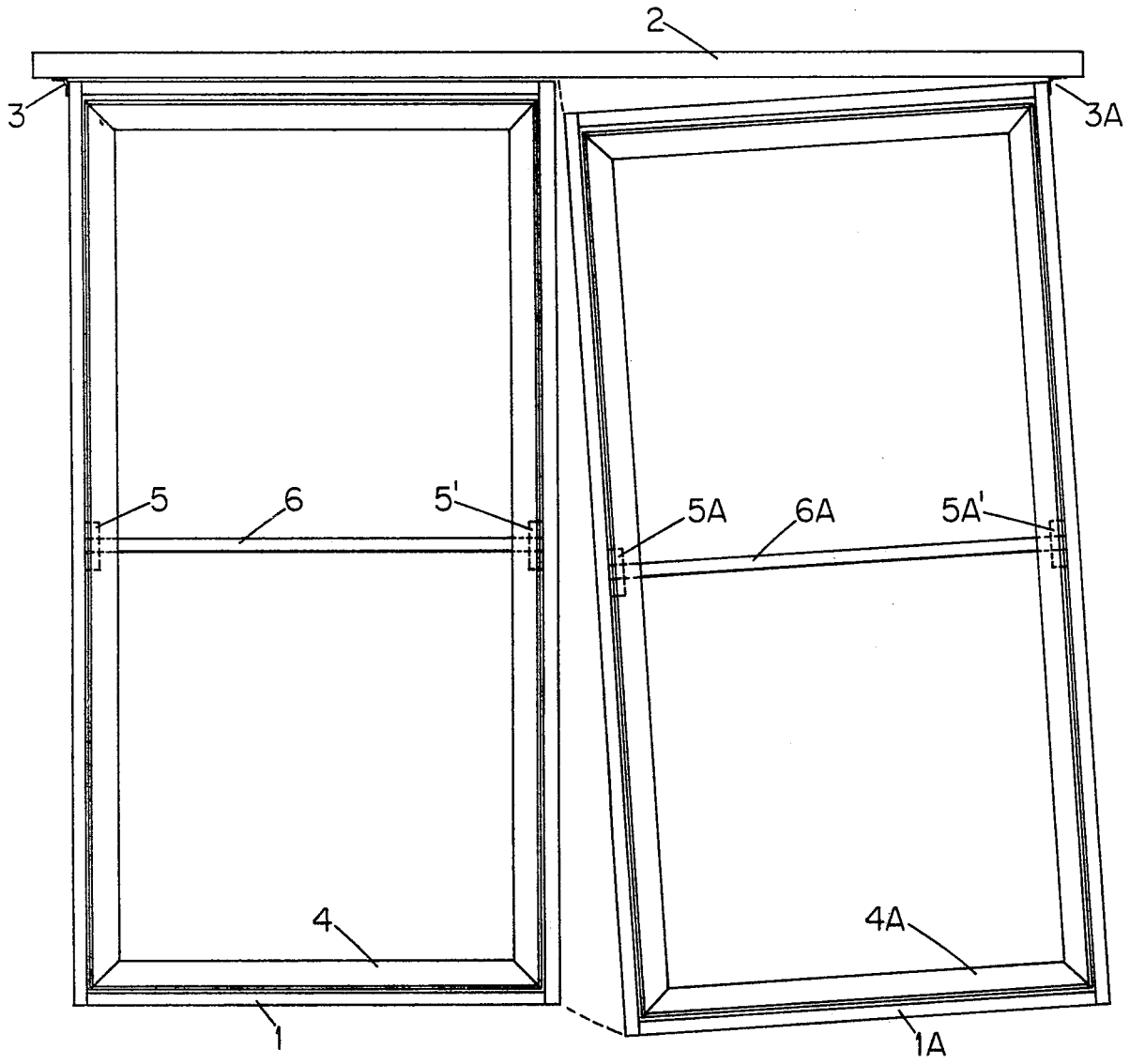
FIG. 1 is a plan view of one embodiment of the invention herein showing a swing-away feature of one side.
Figure 2:
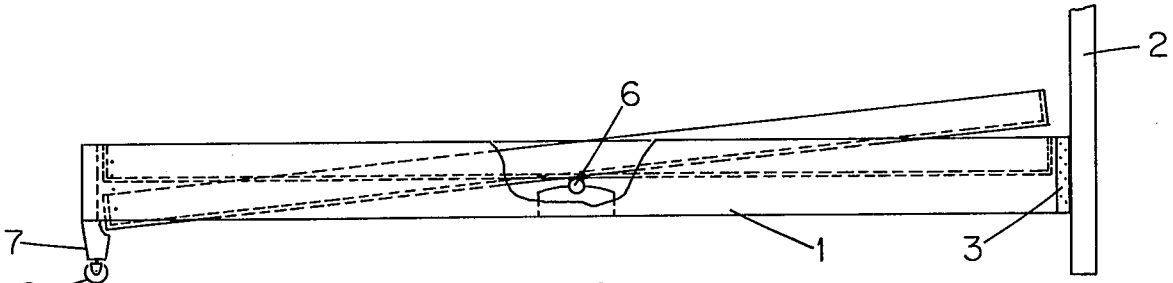
FIG. 2 is a side view of the embodiment of FIG. 1.
Figure 5:
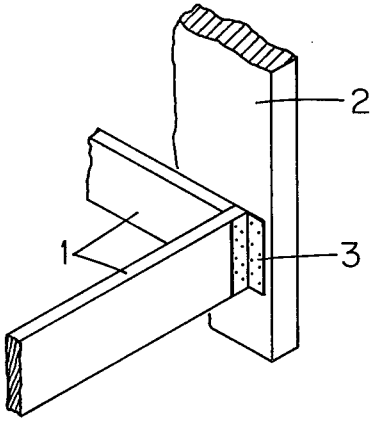
FIGS. 3, 4, and 5 contain detail views of features of FIGS. 1 and 2.

In FIGS. 1 and 2, plan and elevational views are shown of one embodiment of the invention herein to be described. Shown is a support for twin-size mattresses (not shown) to be made up as a queen-size bedding wherein either side may be inclined or level as desired. Similar left and right base frames 1 and 1*a* are pivotally connected (as shown in FIG. 5) to a headboard 2 by hinges 3 and 3*a*, respectively.. A single frame and accessories will be described hereinafter, realizing that similar frame and and accessories exist where apropos.

The base frame 1 is additionally supported at each end of the foot by support legs 7 and rotatable roller casters 8. As the base frame is pivoted clockwise about hinge 3, a space occurs between the frames 1 and 1*a* permitting entry for cleaning under and otherwise preparing the bed before or after usage.

Support frame 4 is pivotally supported approximately midway of and within the base frame 1 by support block 5 and rod 6. The support frame is dimensionally fitted for a twin size mattress within its framework, although the mattress is not shown. Special mattress sizes may also be used as desired.

Figure 3:
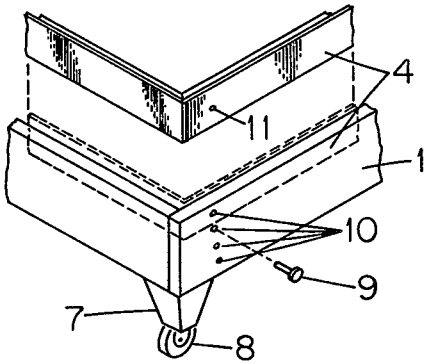

The inclination of the support frame may be controlled simply by removing retaining pins 9 as shown is FIG. 3 from elevating holes 10 and 11 and aligning appropriate elevating holes 10 and 11 for the desired inclination and reinserting the retaining pins 9. Since the support frame is pivotally supported midway, the mattress and frame will be substantially balanced and easy to maneuver for positioning and alignment of elevating holes. Care must be taken to have sufficiently strong retaining pins since the pins may be subjected to high shear forces from concentrated loads away from the center of the bed. While the form of positioning is shown for simplicity, other means of controlling inclination will become apparent to those skilled in the art. Other means are also herein described.

Figure 4:
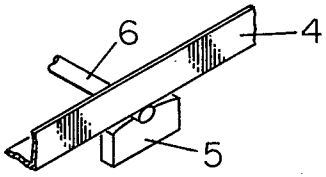

In the embodiment as shown in FIGS. 1 and 4, rod 6 is located across the width of the support frame 4. In this embodiment, the rod 6 is fixedly attached to support frame 4 to add dimensional stability across the width of the frame and rotates upon support blocks 5 on each side of and attached to base frame 1.

In pivoting the support frame 4 midway in the base frame, elevations of several inches may achieve in one or the other side of the bed without having drastic elevational differences with a side remaing level, as is experienced by pivoting from the foot of the base frame, for example. Additionally, it may be advantageous to raise the foot and lower the head of either side and this modification to the above description may be made readily.

Figure 6:
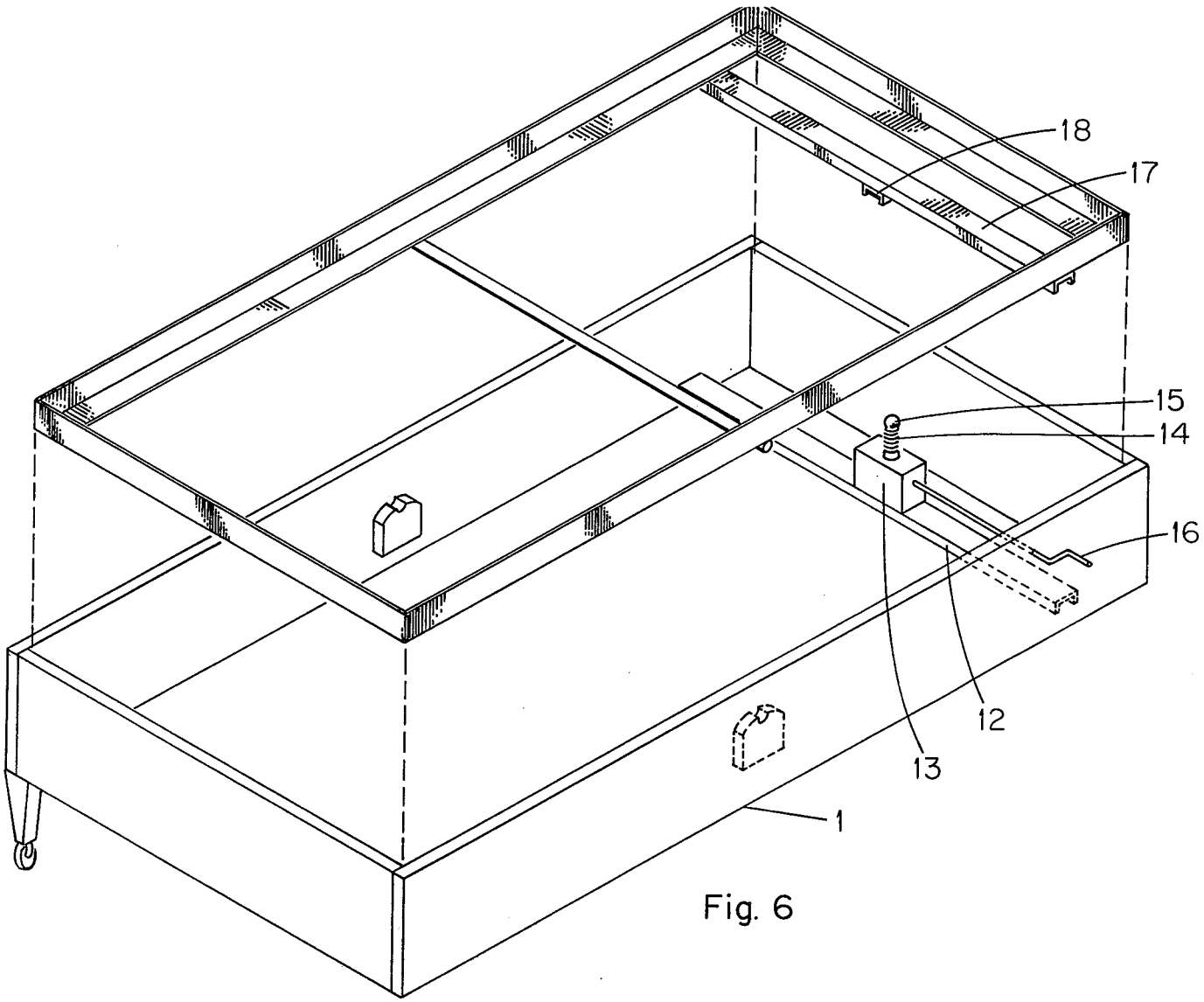
FIG. 6 is an isometric perspective showing another embodiment for raising and lowering one side.
Figure 8:
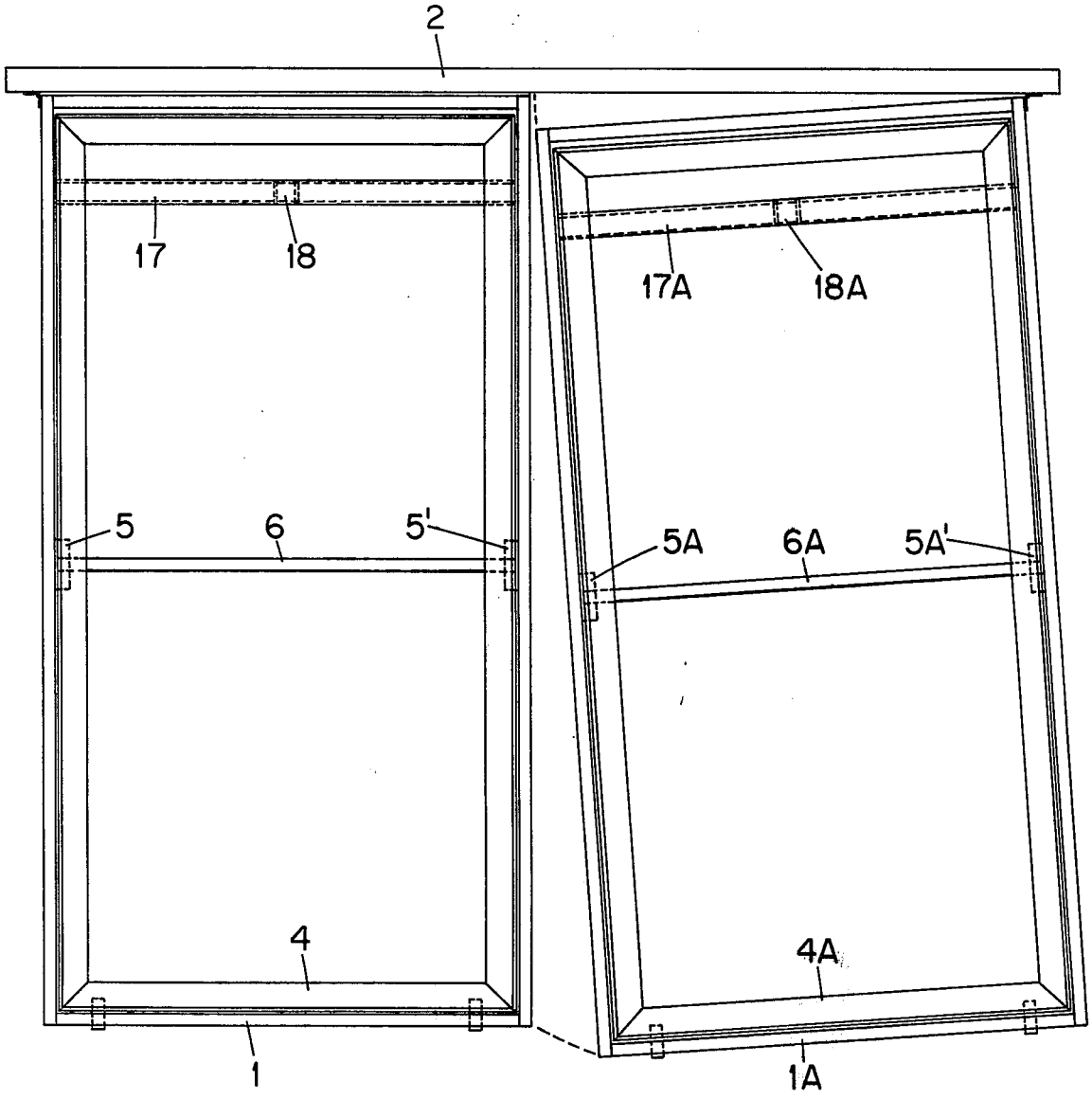
FIGS. 7 and 8 are other views of the embodiment of FIG. 6.
Figure 7:
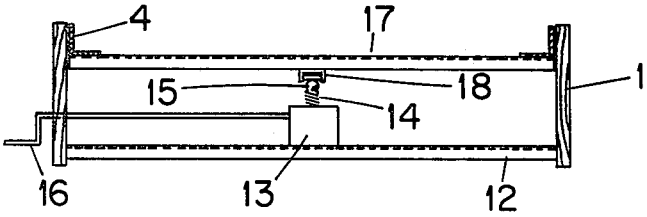
Figure 9:
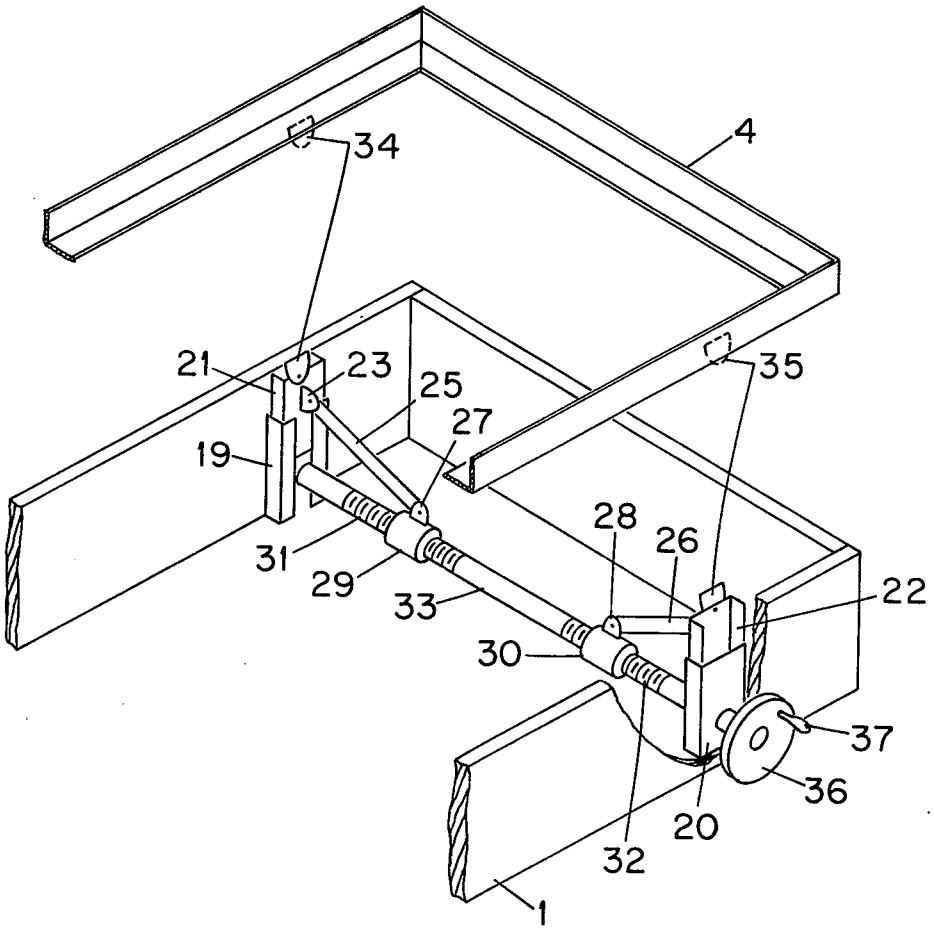
FIG. 9 is another embodiment of raising and lowering one side.

In FIGS. 6, 7, and 8, a bed frame similar to FIG. 1 has, as a height adjusting mechanism, a rotary screw jack 13 mounted in a support member 12 that is fixedly attached to base frame 1. As handle 16 is rotated, threaded rod 14 with ball 15 is rotated and moves vertically upward. Ball 15 is retained loosely in socket 18 mounted on support member 17 so as to permit restricted movement between the ball and socket. Socket 18 is fixedly to support member 17 which in turn is attached to support frame 4. As threaded rod 14 moves up or down, support frame 4 is caused to be pivoted around rod 6 in support blocks 5, thereby raising or lowering the head or foot of the bed frame 4 as desired In FIG. 9, slide guides 19 and 20 are mounted on base frame 1. While the embodiment shown here details only the raising and lowering mechanism, it is understood the remainder of the bed frame is similar to that shown in FIG. 1.

Slides 21 and 22 are restrained by guides 19 and 20 so that only vertical movement is permissable. A rotatable rod 33, fixed to said guides 19 and 20 by conventional means, has oppositely threaded sections 31 and 32. Sleeves 29 and 30 have matching screw threads with threaded sections 30 and 31. Pivot mountings 27 and 28 are rigidly attached to sleeves 29 and 30.

Pivot mounting 23 is attached rigidly to slide 21 as is a similar pivot mounting on slide 22 (not shown). Elongate members 25 and 26 are pivotally attached respectively to pivot mountings 27 and 23 and 28 and the mounting not shown. Chips 34 and 35, while shown here separately, are fixedly attached to slides 21 and 22, respectively.

Wheel 36 with turning knob 37 are fixedly mounted to rod 33 and, when rotated, cause said rod 33 to rotate. Sleeves 29 and 30 are restricted in rotational movement by mountings 27 and 28 and move along the axis of rod 33 a distance of the pitch of the threads 31 and 32 per 360° rotation of rod 33. Slides 21 and 22 are in turn moved upward or downward through translational movement of rigid elongate members 25 and 26, which in turn moves one end of support frame 4 upward or downward.

It can be seen from the above that there is disclosed herein a simple and effective dual purpose home medical bed frame. Various mattress and spring arrangements are contemplated, such as soft and firm supportive mattresses, and where necessary, rigid support means under either or both mattresses for spinal support.

Other embodiments will become evident to those in the art and the disclosures herein are not meant to be limiting. The scope of the invention is set forth in the claims as follows.

What is claimed is:

1. Therapeutic bedding for conventional usage comprising a headboard; first and second base frames vertically pivotally attached to said headboard at the head ends and movable support means at the foot ends of said base frames, said base frames being in side-by-side relationship and each adjacent the headboard at the head end in a closed position and at an angle away from each other in an open position; first and second mattress support frames attached to said first and second base frames, respectively, at least one mattress support frame being horizontally pivotally mounted in its respective base frame about the longitudinal center of said mattress support frame; and means for positioning said support frame at a predetermined level of inclination relative to said base frame about said longitudinal center, said means for positioning said support frame comprising at least one series of openings in said base frame radially equidistant from the pivot axis of said mattress frame, at least one corresponding opening in said mattress support frame, and at least one pin insertable in said base frame and mattress support frame openings to position the relative inclination of said mattress support frame to said base frame at the predetermined level.

2. A therapeutic bedding for conventional usage, comprising; a headboard; first and second base frames vertically pivotally attached to said headboard at the head ends and movable support means at the footends of said base frame, said base frames being in side by side relationship and each adjacent the headboard at the head end in a closed position and at an angle away from each other in an open position; first and second mattress supports attached to said first and second base frames, respectively, at least one mattress support frame being horizontally pivotally mounted in its respective one base frame about the longitudinal center of said mattress support frame; a rod rotatably mounted horizontally and laterally at one end of said one base frame and beneath said one mattress frame, said rod having a threaded screw section thereon and between said rod mounting; a corresponding threaded sleeve for said threaded section; a rigid elongated member pivotally attached to said sleeve and a slide, said slide being attached to said one mattress support frame in a plane substantially vertical to said rod; and means for guiding said slide in a substantially vertical direction.

3. Therapeutic bedding for conventional usage comprising a headboard; first and second base frames vertically pivotally attached to said headboard at the head ends and movable support means at the foot ends of said base frames, said base frames being in side-by-side relationship and each adjacent to the headboard at the head end in a closed position and at an angle away from each other in an open position; first and second mattress support frames attached to said first and second base frames, respectively, at least one mattress support frame being horizontally pivotally mounted and in its respective base frame about the longitudinal center of said mattress support frame; and means for positioning said mattress support frame at a predetermined level of inclination relative to said base frame about said longitudinal center, including a rotary screw jack fixedly attached to said base frame and having a ball mounting atop said jack, a socket fixedly attached to said mattress support frame and loosely surrounding said ball mounting in a retentive manner.

* * * * *